United States Patent [19]

Lifentsev et al.

[11] 4,199,319

[45] Apr. 22, 1980

[54] METHOD FOR TREATMENT OF COTTON YARN

[75] Inventors: Oleg M. Lifentsev; Boris N. Melnikov, both of Ivanovo; Gennady E. Zaitsev, Moscow; Tamara E. Solovieva, Ivanovo, all of U.S.S.R.

[73] Assignee: Ivanovsky Nauchno-Issledovatelsky Institut Khlopchatobumazhnoi Promvshlennosti, U.S.S.R.

[21] Appl. No.: 909,295

[22] Filed: May 24, 1978

[51] Int. Cl.[2] ..... D06M 1/00

[52] U.S. Cl. ..... 8/116 R; 8/115.6; 8/125

[58] Field of Search ..... 8/125, 115.6, 116 R

[56] References Cited

U.S. PATENT DOCUMENTS

| | | | |
|---|---|---|---|
| 3,560,140 | 2/1971 | Gailey | 8/125 |
| 3,767,359 | 10/1973 | Calamari et al. | 8/125 |
| 3,837,056 | 9/1974 | Rendall et al. | 28/281 |

OTHER PUBLICATIONS

Lynn, J. E. and Press, J. J., (Editors), "Advances in Textile Processing", vol. 1, Textile Book Publishers, 1961, pp. 69–70.

Moncrieff, R. W., "Man-Made Fibres", John Wiley, 1975, pp. 197–200.

Ward, K., "Chemistry and Chemical Technology of Cotton", Interscience, 1955, pp. 375–382.

*Primary Examiner*—A. Lionel Clingman

*Attorney, Agent, or Firm*—Steinberg and Blake

[57] ABSTRACT

The invention relates to methods for treating cotton yarn and can be used to the best advantage in the treatment of yarn produced by pneumatic spinning. According to the proposed method, the yarn is impregnated with liquid ammonia and then stretched in an aqueous bath containing a sizing agent in an amount sufficient to increase the yarn strength 18 to 25 percent.

4 Claims, No Drawings

METHOD FOR TREATMENT OF COTTON YARN

FIELD OF THE INVENTION

The present invention relates to chemical processes involved in the manufacture of fiber materials and, more particularly, to methods for treating cotton yarn to be used in the manufacture of a variety of fabrics.

BACKGROUND OF THE INVENTION

In the textile industry, the most advanced technique today is the pneumatic spinning of fiber materials from natural and synthetic fibers and their combinations. The pneumatic spinning has a number of important advantages over the classical spinning techniques, except that in the former case the tensile strength of yarn of the same count is 18 to 20 percent lower than in the latter case. On the other hand, the warp yarn is sized so as to provide for a maximum intensification of the spinning process; as a result, the tensile strength of the yarn is improved because an elastic film adheres to it and individual fibers are glued together. The existing sizing techniques have practically exhausted the possibilities of further increasing the tensile strength and cannot make up for the reduction in the tensile strength of the yarn produced by pneumatic spinning.

As a result, yarn produced by pneumatic spinning is used as weft thread; when it is used as warp thread the operating speed of the looms is reduced.

There is known a method for treating twisted cotton yarn with liquid ammonia (cf. UK Pat. No. 1,141,016; Cl. D1P). According to this method, the mechanical strength of yarn is improved by stretching the thread as ammonia is removed therefrom in hot water. However, this method is inapplicable to the treatment of non-twisted yarn; although the mechanical strength of non-twisted yarn is improved, the method does not adjust all the yarn's parameters to the normal spinning process.

SUMMARY OF THE INVENTION

It is an object of the present invention to provide a method for treating cotton yarn, which would improve the mechanical strength of the yarn.

It is another object of the invention to provide a method for treating cotton yarn so that it should possess the properties of mercerized yarn.

The foregoing and other objects of the invention are attained by providing a method for treating cotton yarn, comprising the operations of impregnating the yarn with liquid ammonia and stretching it in an aqueous bath, which method is characterized in that the stretching takes place in an aqueous bath containing a sizing agent in an amount sufficient to increase the strength of the impregnated yarn 18 to 25 percent.

The proposed method is advantageous in that it is the swollen yarn that is put in the sizing agent solution. The immersion in that solution leads to an instantaneous evaporation of the liquid ammonia contained in the yarn, whereby voids are produced in the yarn, into which the sizing medium penetrates much faster than in the case of the conventional sizing process.

In addition, the sized yarn acquires the properties of mercerized yarn, which is due to the impregnation of the yarn with liquid ammonia; the overall effect is a marked improvement in the yarn properties which are indispensable for normal weaving conditions.

According to the invention, the sizing agent is starch taken in an amount of 30 to 70 g/l, or carboxymethyl cellulose taken in an amount of 30 to 50 g/l, or polyvinyl alcohol taken in an amount of 20 to 30 g/l; all these sizes are equally fit suitable treating cotton yarn used to manufacture calico, satin, shirting, linen, denim and other fabrics.

DETAILED DESCRIPTION OF THE INVENTION

A fuller understanding of the invention will be had from the following examples.

EXAMPLE 1

Unbleached single cotton yarn (tex 29.4), produced from low-count card web cotton, is impregnated during 3 seconds with liquid ammonia at a temperature of −35° C., whereupon the yarn is squeezed to 100% pick-up and treated during 2 seconds in an aqueous solution containing 30 g/l of carboxymethyl cellulose at a temperature of 60° to 65° C.; simultaneously with the treatment, the yarn is stretched 13% lengthwise. The yarn is then dried on the surface of a heated drum and spooled. The basic physico-chemical properties of the yarn thus treated are as follows:

1. Mean breaking load: 427.6 g wt
2. Mean elongation at break: 12.5 mm
3. Size regain: 3.2%
4. Barium number: 132.1%

EXAMPLE 2

Unbleached cotton yarn of tex 29.4 is treated as in Example 1, but the concentration of carbomethyl cellulose is 50 g/l. The physico-chemical properties of the treated yarn are as follows:

1. Mean breaking load: 440.1 g wt
2. Mean elongation at break: 12.2 mm
3. Size regain: 5.3%
4. Barium number: 133.4%

EXAMPLE 3

Unbleached single cotton yarn of tex 25, produced from low-count card web cotton, is impregnated during 3 seconds with liquid ammonia at a temperature of −35° C., whereupon the yarn is squeezed to 100% pick-up and treated during 2 seconds in an aqueous solution containing 30 g/l of starch at a temperature of 90° to 95° C.; simultaneously with the treatment, the yarn is stretched 13% lengthwise. The basic physico-chemical properties of the yarn thus treated are as follows:

1. Mean breaking load: 406.4 g wt
2. Mean elongation at break: 8.5 mm
3. Size regain: 3.9%
4. Barium number: 131.0%

EXAMPLE 4

Unbleached cotton yarn of tex 25 is treated as in Example 3, but the starch concentration in this case is 70 g/l. The physico-chemical properties of the treated yarn are as follows:

1. Mean breaking load: 405.0 g wt
2. Mean elongation at break: 9.1 mm
3. Size regain: 7.6%
4. Barium number: 139.4%

EXAMPLE 5

Unbleached twisted cotton yarn (tex 25×2) is impregnated during 3 seconds in liquid ammonia at a temperature of −35° C., whereupon the yarn is squeezed to 100% pick-up and treated during 2 seconds in an aqueous solution containing 20 g/l of polyvinyl alcohol at a temperature of 80° to 90° C.; in the course of the treatment, the yarn is stretched 15% lengthwise.

The physico-chemical properties of the yarn thus treated are as follows:

1. Mean breaking load: 888.5 g wt
2. Mean elongation at break: 14.1 mm
3. Size regain: 2.2%
4. Barium number: 132.1%

EXAMPLE 6

Twisted cotton yarn (tex 25×2) is treated as in Example 5, but in this case the concentration of polyvinyl alcohol is 30 g/l. The physico-chemical properties of the yarn after treatment are as follows:

1. Mean breaking load: 901.8 g wt
2. Mean elongation at break: 14.0 mm
3. Size regain: 3.1%
4. Barium number: 131.9%

The basic physico-chemical properties of cotton yarn treated as in Examples 1 through 6 illustrated the relationship between the quality of the yarn, on the one hand, and the type and concentration of the sizing medium and the type of yarn, on the other. These properties are tabulated in the following table.

Table

| | | Results of Cotton Yarn Testing | | | | | | | | | | | |
|---|---|---|---|---|---|---|---|---|---|---|---|---|---|
| | | Types of Treatment | | | | | | | | | | | |
| | | No 1 Initial yarn | | | No 2 Mercerized with liquid ammonia | | | No 3 | No 4 | No 5 | No 6 | No 7 | No 8 |
| | | | | | | | | Treated with liquid ammonia and sized with | | | | | |
| | | | | | | | | carboxymethyl starch cellulose | | | | polyvinyl alcohol | |
| | | Cotton yarn, tex | | | | | | | | | | | |
| | | 29.4 | 25 | 25 × 2 | 29.4 | 25 | 25 × 2 | 29.4 | | 25 | | 25 × 2 | |
| Serial No | Parameter | 1 | 2 | 3 | 4 | 5 | 6 | 7 | | 8 | | 9 | |
| 1. | Mean breaking load, g wt | 314.4 | 289.8 | 643.8 | 371.2 | 342.5 | 773 | 427.6 | 440.1 | 406.4 | 405.0 | 888.5 | 901.8 |
| 2. | Mean elongation at break, mm | 34.0 | 24.9 | 34.8 | 12.7 | 10.6 | 14.2 | 12.5 | 12.2 | 8.5 | 9.1 | 14.1 | 14.0 |
| 3. | Size regain | — | — | — | — | — | — | 3.2 | 5.3 | 3.9 | 7.6 | 2.2 | 3.1 |
| 4. | Barium number | — | — | — | 131.5 | 130.5 | 132.0 | 132.1 | 133.4 | 131.0 | 139.4 | 132.1 | 131.9 |
| 5. | Increase in breaking load, as compared to breaking load of initial yarn, % | — | — | — | 18.1 | 18.2 | 20.1 | 36 | 40 | 40.2 | 39.8 | 38.0 | 40.1 |
| 6. | Reduction in elongation at break, as compared to elongation at break of initial yarn, % | — | — | — | 62.7 | 57.4 | 59.2 | 63.2 | 64.1 | 65.9 | 63.5 | 59.5 | 59.8 |

Note: the types of treatment listed in the Table are designated as follows:

1—initial untreated yarn (tex 29.4, 25, 25×2);

2—yarn treated with liquid ammonia in the known manner (tex 29.4, 25, 25×2);

3, 4—yarn of tex 29.4 impregnated during 3 seconds with liquid ammonia at a temperature of −35° C., whereupon the yarn is stretched 13% lengthwise and simultaneously treated during 2 seconds with a solution of carboxymethyl cellulose with a concentration of 30 to 50 g/l at a temperature of 60° to 65° C. so as to raise the strength of the mercerized yarn 18 to 20 percent;

5, 6—yarn of tex 25, impregnated during 3 seconds with liquid ammonia at a temperature of −35° C., whereupon the yarn is stretched 13% lengthwise and simultaneously treated during 2 seconds with an aqueous starch solution having a concentration of 30 to 70 g/l at a temperature of 90° to 95° C. so as to raise the strength of the mercerized yarn 20 to 22 percent;

7, 8—yarn of tex 25×2, impregnated during 3 seconds with liquid ammonia at a temperature of −35° C., whereupon the yarn is stretched 15% lengthwise and simultaneously treated during 2 seconds with an aqueous solution of polyvinyl alcohol having a concentration of 20 to 30 g/l at a temperature of 80° to 90° C. so as to raise the strength of the mercerized yarn 20 to 25 percent.

Thus the proposed method, whereby the mercerization and sizing are carried out simultaneously, makes up for the 18% to 20% loss in the breaking strength of cotton yarn, which loss is due to the pneumatic spinning of that yarn. In addition, when treated in accordance with the method of this invention, the yarn acquires the properties of mercerized yarn. All these factors help to reduce the warp thread breakage and simplify the subsequent processes of dying and finishing unbleached fabrics.

What is claimed is:

1. Method of treating cotton yarn, which comprises impregnating cotton yarn with liquid ammonia; immersing and stretching the thus liquid ammonia-impregnated yarn in an aqueous bath containing a sizing agent in an amount sufficient to increase the yarn's strength 18 to 25 percent, whereby the liquid ammonia contained in the yarn evaporates to form voids in the yarn and the sizing agent rapidly penetrates into the thus formed voids, thus increasing the strength of the yarn; and drying and spooling the thus stretched yarn.

2. The method of claim 1, wherein the sizing agent is starch taken in an amount of 30 to 70 g/l.

3. The method of claim 1, wherein the sizing agent is carboxymethyul cellulose taken in an amount of 30 to 50 g/l.

4. The method of claim 1, wherein the sizing agent is polyvinyl alcohol taken in an amount of 20 to 30 g/l.

* * * * *